US008874017B2

(12) United States Patent
Takeuchi

(10) Patent No.: US 8,874,017 B2
(45) Date of Patent: Oct. 28, 2014

(54) FIXING DEVICE THAT SUPPRESSES ENERGY LOSS CAUSED BY HEAT RELEASE TO OUTSIDE THEREOF AND IMAGE FORMING APPARATUS EQUIPPED WITH SAME

(71) Applicant: Kyocera Document Solutions Inc., Osaka (JP)

(72) Inventor: Toshimitsu Takeuchi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 64 days.

(21) Appl. No.: 13/889,985

(22) Filed: May 8, 2013

(65) Prior Publication Data

US 2013/0302073 A1 Nov. 14, 2013

(30) Foreign Application Priority Data

May 9, 2012 (JP) ..... 2012-107887

(51) Int. Cl.
*G03G 15/20* (2006.01)

(52) U.S. Cl.
CPC ..... *G03G 15/2039* (2013.01); *G03G 15/2017* (2013.01); *G03G 15/2064* (2013.01)
USPC ..... 399/330

(58) Field of Classification Search
CPC ..... G03G 15/2017; G03G 15/2078
USPC ..... 399/94, 330
See application file for complete search history.

(56) References Cited

U.S. PATENT DOCUMENTS

| | | | | |
|---|---|---|---|---|
| 3,998,584 | A * | 12/1976 | Wada et al. | 432/60 |
| 6,785,493 | B2 * | 8/2004 | Repole | 399/122 |
| 7,013,099 | B2 * | 3/2006 | Shirakata | 399/92 |

FOREIGN PATENT DOCUMENTS

| | | |
|---|---|---|
| JP | 05-134572 | 5/1993 |
| JP | 05-181381 | 7/1993 |

* cited by examiner

*Primary Examiner* — Gregory H Curran
(74) *Attorney, Agent, or Firm* — K&L Gates LLP

(57) ABSTRACT

A fixing device includes a fixing member, a housing, and heating-side and pressing-side heat conservation plates. The fixing member includes a heating member and a pressing member that is in pressure contact with the heating member. The housing includes the fixing member and has openings on upstream and downstream sides in a recording medium transportation direction. The heating-side heat conservation plate opposes the heating member so as to be spaced apart from an outer peripheral surface of the heating member. The pressing-side heat conservation plate opposes the pressing member so as to be spaced apart from an outer peripheral surface of the pressing member. A distance between the pressing member and the pressing-side heat conservation plate is greater than a distance between the heating member and the heating-side heat conservation plate.

12 Claims, 7 Drawing Sheets

FIXING DEVICE THAT SUPPRESSES ENERGY LOSS CAUSED BY HEAT RELEASE TO OUTSIDE THEREOF AND IMAGE FORMING APPARATUS EQUIPPED WITH SAME

INCORPORATION BY REFERENCE

This application is based upon and claims the benefit of priority from the corresponding Japanese Patent Application No. 2012-107887, filed May 9, 2012, the entire contents of which are incorporated herein by reference.

BACKGROUND

The present disclosure relates to fixing devices and image forming apparatuses such as copiers and printers equipped with the fixing device, and in particular, relates to improvements in the heat insulating properties of the fixing devices.

An image forming apparatus includes a charger unit, an image carrying body (photoconductor drum), an exposure unit, a developing unit, a transfer unit, and a fixing device. The fixing device causes a toner image to be fixed onto a recording medium by heating and pressing unfixed toner.

In the fixing device described above, the heat not used in the fixing operation is released outside of the fixing device. Thus, unnecessary heat is transferred to a photoreceptor and a cleaning unit, which are located around the fixing device. As a result, the drive torque of the apparatus is increased due to compression of the toner. Operation of the apparatus may be stopped or an abnormal density observed due to non-uniform charge on the surface of the photoreceptor. Furthermore, since the heat released from the fixing device increases the inner temperature of the apparatus, other systems inside the apparatus may be adversely affected, thereby the image quality and durability of components may be degraded.

Measures such as suppressing temperature rise by providing airflows between the fixing device and other systems have been used. However, cooling the fixing device results in an increase in unnecessary energy consumption due to an increase in the amount of heat generation for ensuring the necessary amount of heat required for a fixing operation.

In view of the above-described situation, a method has been proposed, in which heat release from the fixing device is suppressed without using a cooling unit such as a fan. For example, there is a technology in which, in a heat-roller type fixing device, heat released from a fixing roller is suppressed by positioning around the fixing roller a heat insulating material that blocks heat released from the fixing roller and by forming a heat insulating air layer between the inner circumferential surface of the heat insulating material and the outer circumferential surface of the fixing roller. Also, in a fixing device, a heat insulating material is located on the inner wall surfaces of the upper and lower covers of the fixing unit, the upper and lower covers opposing a fixing roller and a pressure roller.

From the viewpoint of energy savings, a reduction in stabilization time for fixing and reduction in energy consumption are important. For these tasks, diameters and thicknesses of fixing rollers have been reduced so as to improve temperature rise characteristics of the fixing rollers.

However, when rollers having a small thickness are used as the fixing rollers, the fixing rollers have a small heat capacity. Thus, it is difficult to effectively suppress heat release from the fixing rollers even when heat insulating materials are provided.

SUMMARY

A fixing device according to an embodiment of the present disclosure includes a fixing member, a housing, a heating-side heat conservation plate, and a pressing-side heat conservation plate. The fixing member includes a heating member heated by a heating unit and a pressing member that is in pressure contact with the heating member at a specified pressure. The housing includes the fixing member and has openings on an upstream side and a downstream side in a recording medium transportation direction. The heating-side heat conservation plate is positioned opposite the heating member so as to be spaced apart from an outer peripheral surface of the heating member by a specified distance and has a metal plate having a shape that conforms to the outer peripheral surface of the heating member. The pressing-side heat conservation plate is positioned opposite the pressing member so as to be spaced apart from an outer peripheral surface of the pressing member by a specified distance and has a metal plate having a shape that conforms to the outer peripheral surface of the pressing member. The distance between the pressing member and the pressing-side heat conservation plate is greater than the distance between the heating member and the heating-side heat conservation plate.

An image forming apparatus according to another embodiment of the present disclosure includes the above-described fixing device.

A fixing device according to an embodiment of the present disclosure includes a fixing member, a housing, a heating-side heat conservation plate, and a pressing-side heat conservation plate. The fixing member includes a heating member heated by a heating unit and a pressing member that is in pressure contact with the heating member at a specified pressure. The housing includes the fixing member and has openings on an upstream side and a downstream side in a recording medium transportation direction. The heating-side heat conservation plate is positioned opposite the heating member so as to be spaced apart from an outer peripheral surface of the heating member by a specified distance and has a metal plate having a shape that conforms to the outer peripheral surface of the heating member. The pressing-side heat conservation plate is positioned opposite the pressing member so as to be spaced apart from an outer peripheral surface of the pressing member by a specified distance and has a metal plate having a shape that conforms to the outer peripheral surface of the pressing member. The distance between the pressing member and the pressing-side heat conservation plate is greater than the distance between the heating member and the heating-side heat conservation plate.

An image forming apparatus according to another embodiment of the present disclosure includes the above-described fixing device.

Additional features and advantages are described herein, and will be apparent from the following Detailed Description and the figures.

DETAILED DESCRIPTION

Figure 1:
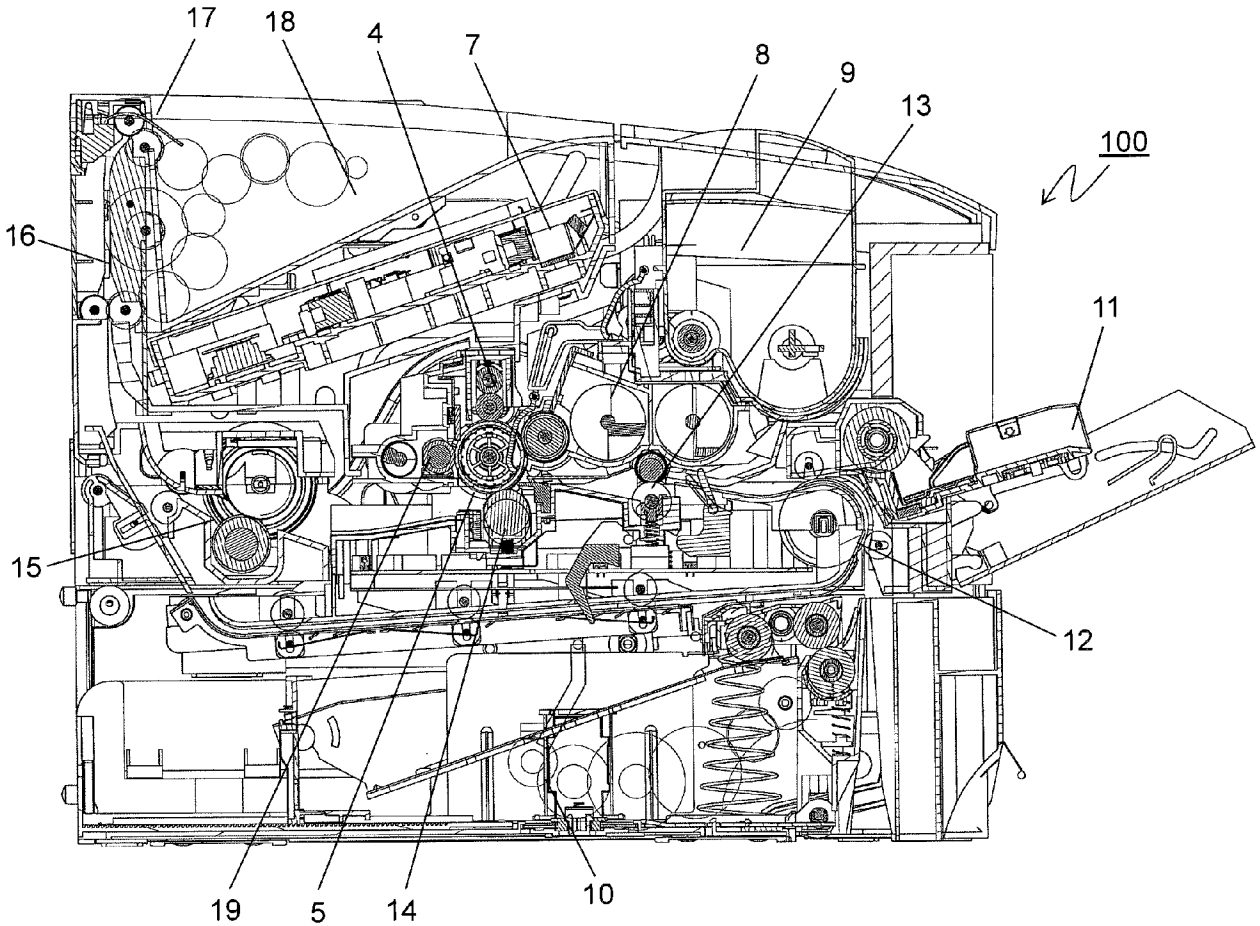
FIG. 1 is a side sectional view of an internal structure of an image forming apparatus equipped with a fixing device, according to an example embodiment of the present disclosure.

An embodiment according to the present disclosure will be described below with reference to the drawings. FIG. 1 is a side sectional view of an internal structure of an image forming apparatus 100 in which a fixing device 15 according to an embodiment of the present disclosure is provided. When an image forming operation is performed in the image forming apparatus (monochrome printer) 100, a photoconductor drum 5 that is rotated clockwise in FIG. 1 is uniformly charged by a charger unit 4, an exposure unit (laser scanning unit) 7 exposes the photoconductor drum 5 with a laser beam based on the original image data so as to form an electrostatic latent image on the photoconductor drum 5, and a developing unit 8 causes a developer (toner) to adhere to the electrostatic latent image so as to form a toner image.

The toner is supplied from a toner container 9 to the developing unit 8. The image data is transmitted from a personal computer (not shown) or the like. A static eliminator (not shown), which removes charges remaining on the surface of the photoconductor drum 5, is provided downstream of a cleaning device 19.

A sheet contained in a sheet feed cassette 10 or a manual feed tray 11 is fed through a sheet transportation path 12 and a registration roller pair 13 to the photoconductor drum 5, on which the toner image has been formed. The toner image formed on the surface of the photoconductor drum 5 is transferred onto the sheet by a transfer roller 14 (image transfer unit). The sheet, onto which the toner image has been transferred, is separated from the photoconductor drum 5 and transported to the fixing device 15, so that the toner image is fixed onto the sheet. The sheet having passed through the fixing device 15 is fed through a sheet transportation path 16 to an upper portion of the apparatus and ejected to a delivery tray 18 by a delivery roller pair 17.

Figure 2:
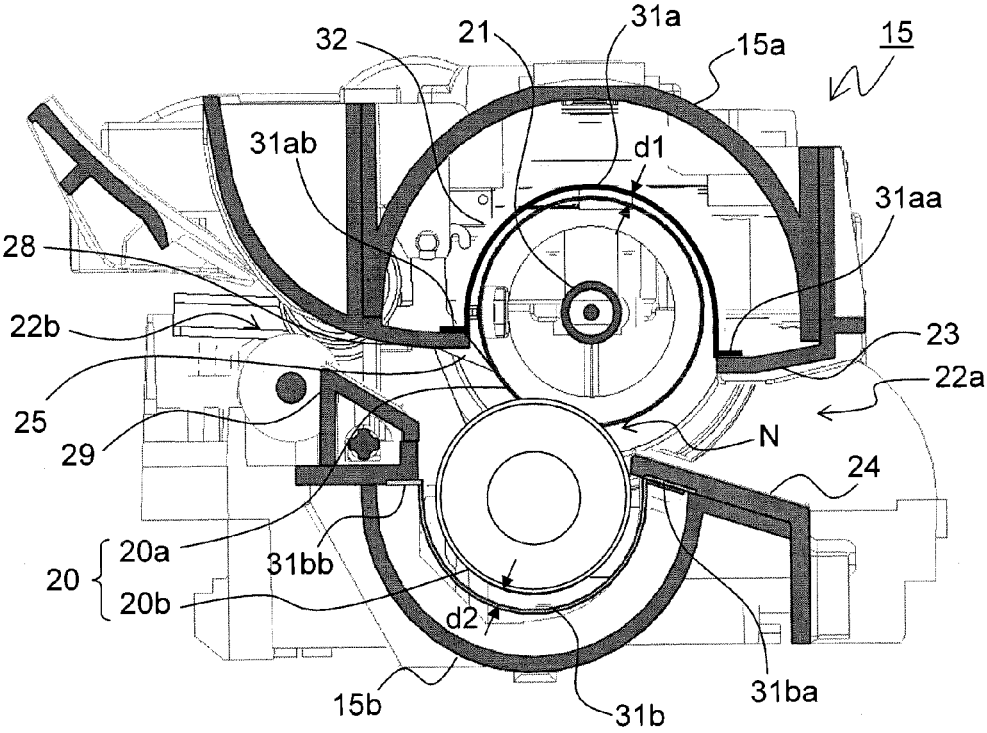
FIG. 2 is a side sectional view of a fixing device, according to an example embodiment of the present disclosure.
Figure 3:
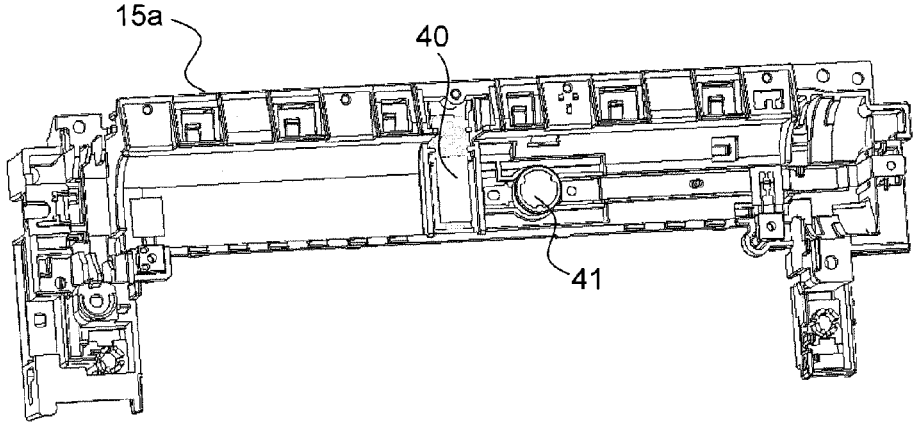
FIG. 3 is a perspective view of an upper housing of the fixing device viewed from inside the fixing device.

FIG. 2 is a side sectional view illustrating an example of the fixing device 15 according to the present disclosure. FIG. 3 is a perspective view of an upper housing 15*a* of the fixing device 15 viewed from inside the fixing device 15. In FIG. 3, a heating-side heat conservation plate 31*a* is removed from an inner surface of the upper housing 15*a*.

A housing of the fixing device 15 has the upper housing 15*a* and a lower housing 15*b*, which are formed of resin. A heating roller 20*a* (heating member), which is rotated clockwise in FIG. 2, is housed in the upper housing 15*a*. A pressure roller 20*b* (pressing member), which is rotated counterclockwise, is housed in the lower housing 15*b*. The heating roller 20*a* includes a heater 21 (heating unit) located therein. The pressure roller 20*b* is in pressure contact with the heating roller 20*a* at a specified pressure by an urging member (not shown). The heating roller 20*a* and the pressure roller 20*b* are part of a fixing roller pair 20 (fixing member) that fixes unfixed toner onto the sheet passing through a fixing nip portion N.

The heating roller 20*a* according to an embodiment is formed by, for example, laminating a 25 μm thick tetrafluoroethylene-perfluoroalkylvinylether copolymer (PFA) coating layer (mold release layer) on an outer circumferential surface of an aluminum cored bar having a 27 mm outer diameter. The pressure roller 20*b* is formed by stacking a 6.5 mm thick silicone rubber layer (elastic layer) on a cored bar having a 12 mm outer diameter and by covering the resultant structure with a PFA tube (mold release layer).

The heater 21 uses, for example, a halogen heater or an induction heating (1H) heater equipped with an induction heating unit having an exciting coil and a core. The heater 21 according to an embodiment uses a halogen heater of an 800 W output.

The sheet, onto which the toner image has been transferred by the transfer roller 14 (see FIG. 1), is fed leftward in FIG. 2, transported into the fixing device 15 through an upstream opening 22*a*, and passes through the fixing nip portion N of the fixing roller pair 20. The sheet passing through the fixing nip portion N is heated and pressed at a specified temperature and a specified pressure, thereby the toner image is fixed onto the sheet. After that, the sheet is transported outside of the fixing device 15 through a downstream opening 22*b* and ejected outside of the image forming apparatus by the delivery roller pair 17 (see FIG. 1).

A fixing entrance guide 23, which guides the upper side of the sheet that is entering the fixing nip portion N, is located at the upstream opening 22*a*. Part of the lower housing 15*b* defines a fixing entrance guide 24, which guides the lower side of the sheet that is entering the fixing nip portion N. A leading end of the sheet is guided into the fixing nip portion N along guiding surfaces of the fixing entrance guides 23 and 24. Part of the upper housing 15*a* defines a fixing exit guide 28, which guides the upper side of the sheet having passed through the fixing nip portion N. Part of the lower housing 15*b* defines a fixing exit guide 29, which guides the lower side of the sheet having passed through the fixing nip portion N. A fixing exit switch (not shown) that detects passage of the sheet through the fixing nip portion N is located in the fixing exit guide 29.

Separation tabs 25 are positioned downstream of the fixing nip portion N with respect to the rotational direction of the heating roller 20*a* (clockwise in FIG. 2). The separation tabs 25 separate the sheet from the heating roller 20*a*. The separation tabs 25 are located at a plurality of positions in the axial direction (direction perpendicular to the page of FIG. 2) of the heating roller 20*a* so that the tips of the separation tabs 25 are in contact with an outer circumferential surface of the heating roller 20*a*.

As illustrated in FIG. 3, a thermistor 40 and a thermostat 41 are positioned in a substantially central portion of the inner surface of the upper housing 15*a*. The thermistor 40 detects the surface temperature of the heating roller 20*a* in a non-contact manner. The thermostat 41 cuts off power supply to the heater 21 when the temperature of the heating roller 20*a* increases to equal to or greater than a specified temperature. The thermistor 40 detects the surface temperature of the heating roller 20*a*, thereby the current flowing through the heater 21 is turned on or turned off so as to control the fixing temperature.

The heating-side heat conservation plate 31*a*, which has an arc shape in side view, is positioned between the inner surface of the upper housing 15*a* and the heating roller 20*a* along the outer circumferential surface of the heating roller 20*a*. A pressing-side heat conservation plate 31*b*, which has an arc shape in side view, is positioned between an inner surface of the lower housing 15*b* and the pressure roller 20*b* along an outer circumferential surface of the pressure roller 20*b*. The heating-side heat conservation plate 31*a* and the pressing-side heat conservation plate 31*b* reflect radiant heat from the heating roller 20*a*, thereby suppressing the heat to be released outside of the fixing device 15. The heating-side heat conservation plate 31*a* and the pressing-side heat conservation plate 31*b* are formed of a metal sheet such as an aluminum sheet, a galvanized steel sheet (SECC sheet), or a stainless steel (SUS) sheet. Here, in order to prioritize the heat conserving effect of the heating roller 20*a*, metal having a large heat capacity may be used.

The gap between the inner surface of the upper housing 15*a* and the heating-side heat conservation plate 31*a* and the gap between the inner surface of the lower housing 15*b* and the pressing-side heat conservation plate 31*b* are preferably set as large as possible. By doing this, air layers existing in the gaps function as heat insulating layers, thereby suppressing the release of heat from the heating-side heat conservation plate 31*a* toward the upper housing 15*a* and from the pressing-side heat conservation plate 31*b* toward the lower housing 15*b*.

On the heating roller 20*a* side, heat transfer of heated air due to air convection needs to be suppressed so as to improve the heat conserving effect. In particular, it is important to suppress the heat release from the sheet entrance side (upstream opening 22*a* side), which largely opens toward the outside of the fixing device 15. For this reason, the heating-side heat conservation plate 31*a* is positioned near the heating roller 20*a* (with a gap d1 therebetween) so as to cover the outer circumferential surface of the heating roller 20*a* as much as possible. Here, the size of the gap d1 is set to 2 mm.

Furthermore, in order not to release heat outside of the fixing device 15 from the upstream opening 22*a* through the heating-side heat conservation plate 31*a* functioning as a heat releasing plate, an end edge 31*aa* of the heating-side heat conservation plate 31*a*, in the circumferential direction of the heating-side heat conservation plate 31*a*, is covered with the upper housing 15*a* (fixing entrance guide 23) having a greater heat insulating property than that of the heating-side heat conservation plate 31*a*. Also, an end edge 31*ab* of the heating-side heat conservation plate 31*a* on the downstream opening 22*b* side is covered with the upper housing 15*a* (fixing exit guide 28), thereby suppressing the release of heat from the downstream opening 22*b*.

On the pressure roller 20*b* side, it is important to decrease heat transfer to the pressing-side heat conservation plate 31*b* and supply an amount of heat toward the heating roller 20*a*. For this reason, a gap d2 between the pressure roller 20*b* and the pressing-side heat conservation plate 31*b* is set to be greater than the gap d1 between the heating roller 20*a* and the heating-side heat conservation plate 31*a*. Here, the size of the gap d2 is set to 3 to 5 mm.

Furthermore, in order not to release heat outside of the fixing device 15 from the upstream opening 22*a* through the pressing-side heat conservation plate 31*b* functioning as a heat releasing plate, an end edge 31*ba* of the pressing-side heat conservation plate 31*b*, in the circumferential direction of the pressing-side heat conservation plate 31*b*, is covered with the lower housing 15*b* (fixing entrance guide 24) having a greater heat insulating property than that of the pressing-side heat conservation plate 31*b*. Also, an end edge 31*bb* of the pressing-side heat conservation plate 31*b* on the downstream opening 22*b* side is covered with the lower housing 15*b* (fixing exit guide 29), thereby suppressing release of heat from the downstream opening 22*b*.

With the above-described structure, the heat of the pressure roller 20*b* after a printing operation has been performed is effectively conserved, and an amount of heat is supplied from the pressure roller 20*b* to the heating roller 20*a*. This reduces the energy to be consumed in order to increase the temperature of the heating roller 20*a* to a temperature at which fixing can be performed for the next printing. Furthermore, the time period to wait until the temperature increases to the temperature at which fixing can be performed is reduced. Thus, even when a thin roller, the heat capacity of such heating roller 20*a* being small and with which the heat conserving effect to be produced is small, is used, by improving the heat conserving effect (heat accumulating effect) of the pressure roller 20*b*, power consumption required for increasing the temperature of the heating roller 20*a* can be reduced.

Furthermore, in an embodiment, since the sheet that enters the fixing device 15 is transported in a horizontal transportation direction (from right to left in FIG. 2), the heating roller 20*a* is positioned at an upper position relative to the pressure roller 20*b*. Thus, heat accumulated in the pressure roller 20*b* is conducted upward and is effectively supplied to the heating roller 20*a*. This allows the heat accumulated in the pressure roller 20*b* to be effectively utilized.

Figure 4:
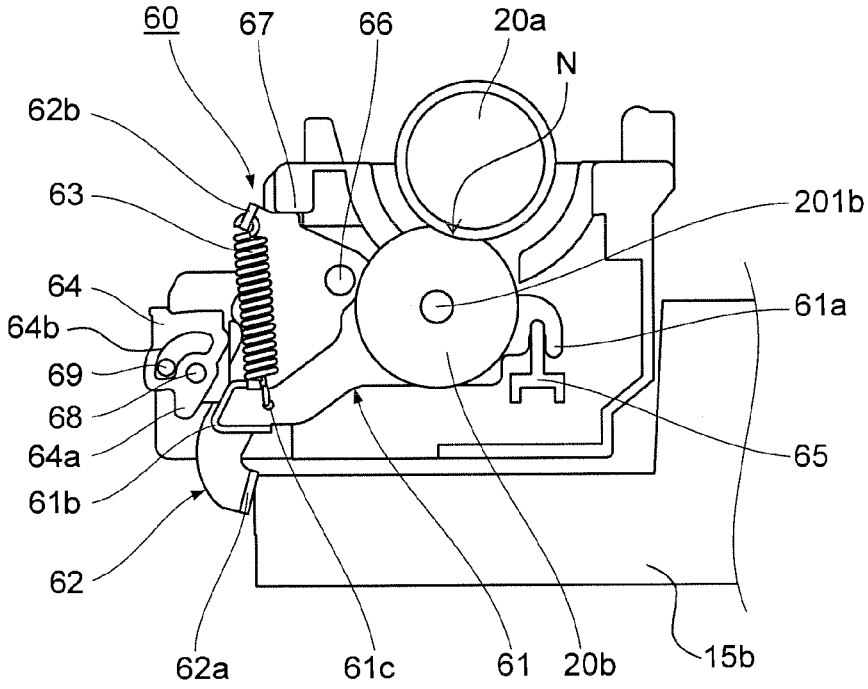
FIG. 4 is a side view of the structure of a nip pressure adjustment mechanism of the fixing device.
Figure 5:
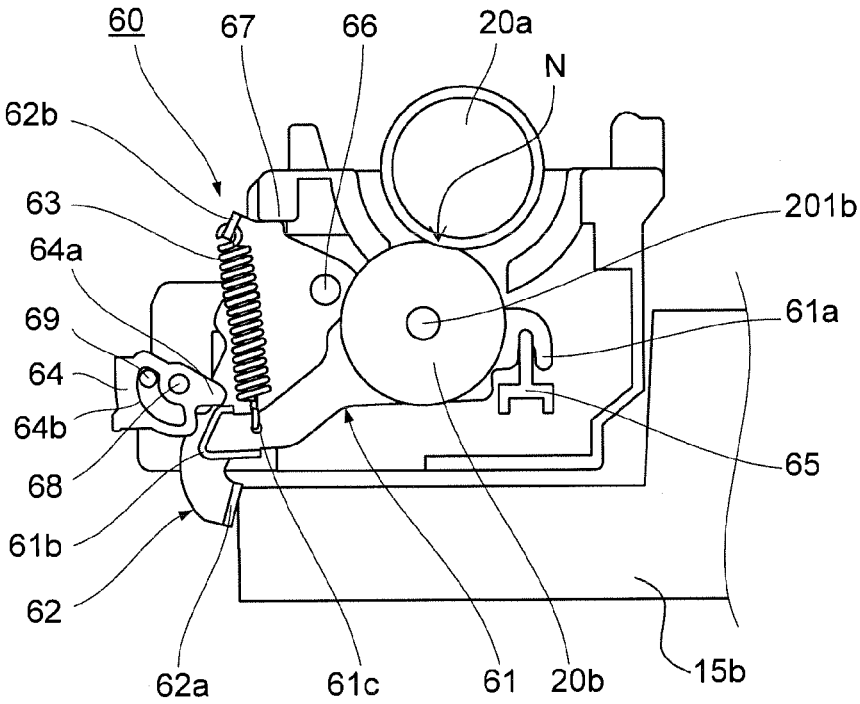
FIG. 5 is a side view of the fixing device when a fixing nip pressure is reduced from that illustrated in FIG. 4.

The fixing device 15 also includes nip pressure adjustment mechanisms 60, which cause the pressure roller 20*b* to be in pressure contact with the heating roller 20*a* so as to form the fixing nip portion N and switches the nip pressure in the fixing nip portion N. FIG. 4 is a side view illustrating the structure of one of the nip pressure adjustment mechanisms 60 of the fixing device 15. FIG. 5 is a side view of the nip pressure adjustment mechanism 60, in which the fixing nip pressure is reduced from the state illustrated in FIG. 4.

As illustrated in FIG. 4, each nip pressure adjustment mechanism 60 includes components such as a swing bearing 61, a separation lever 62, an urging spring 63, and a switching lever 64. The nip pressure adjustment mechanisms 60 are located in both end portions of the lower housing 15*b*. Referring to FIGS. 4 and 5, operation of the one nip pressure adjustment mechanism 60 of the fixing device 15 is described. The other nip pressure adjustment mechanism 60 operates similarly to the one nip pressure adjustment mechanism 60.

The swing bearing 61 supports a rotational shaft 201*b* of the pressure roller 20*b* such that the rotational shaft 201*b* is rotatable relative to the swing bearing 61. The swing bearing 61 has a support portion 61*a* formed in one end portion thereof and is swingably supported by a support portion 65 provided in the lower housing 15*b* at the support portion 61*a*. The swing bearing 61 also has a pressure portion 61*b* provided thereon at the tip on a side opposite to the support portion 61*a* (downstream side with respect to the sheet transportation direction) with a portion thereof that supports the rotational shaft 201*b* interposed between the support portion 61*a* and the pressure roller 20*b*.

The separation lever 62 is positioned on the rear side (downstream with respect to the sheet transportation direction) of the pressure roller 20*b* and rotatably supported by a fulcrum pin 66 formed on the lower housing 15*b*. A lower end portion of the separation lever 62 protrudes downwardly to a lower portion of the lower housing 15*b* and has a contact portion 62*a* at its tip. The contact portion 62*a* is in contact with the lower housing 15*b*. The separation lever 62 has an engagement portion 62*b* in its upper portion. The urging spring 63 extends so as to connect the engagement portion 62*b* and an engagement hole 61*c* provided in the swing bearing 61 to each other.

The switching lever 64 is positioned near the pressure portion 61*b* of the swing bearing 61. The switching lever 64 is rotatably supported by a fulcrum pin 68 provided on the lower housing 15*b*. The switching lever 64 has a sector-shaped opening 64*b*, which is engaged with a restriction pin 69 provided on the lower housing 15*b*. Since the opening 64*b* is engaged with the restriction pin 69, rotation of the switching lever 64 is restricted between specified positions.

The separation lever 62 is positioned so that its upper end edge is in contact with a restriction portion 67 provided in the lower housing 15*b*. The urging spring 63 urges the swing bearing 61 to rotate clockwise in FIG. 4 about the support portion 65. In the state illustrated in FIG. 4, the pressure roller 20*b* is in pressure contact with the heating roller 20*a* such that the contact pressure (fixing nip pressure) of the pressure roller 20*b* against the heating roller 20*a* is in a pressure contact state adequate for fixing a single-sheet recording medium such as a sheet of plain paper (first pressure contact state).

As illustrated in FIG. 4, when the fixing nip pressure is in the first pressure contact state, a protrusion portion 64*a* of the switching lever 64 is positioned so as to not be in contact with the pressure portion 61*b* (first position).

By rotating the switching lever 64 counterclockwise from the state illustrated in FIG. 4, the protrusion portion 64*a* of the switching lever 64 is brought into contact with an upper surface of the pressure portion 61*b*, thereby rotating the swing bearing 61 counterclockwise against the urging force of the urging spring 63. When the switching lever 64 has been rotated to the position illustrated in FIG. 5 (second position), the fixing nip pressure is in a specified pressure contact state in which the fixing nip pressure is less than that in the first pressure contact state (second pressure contact state).

When the switching lever 64 is rotated to the second position, the switching lever 64 is urged so as to be rotated counterclockwise by the swing bearing 61, which is urged by the urging spring 63. However, the switching lever 64, which is engaged with the restriction pin 69, does not further rotate counterclockwise beyond the position illustrated in FIG. 5. That is, by rotating the switching lever 64 to the second position, the swing bearing 61 can be retained at this position.

As described above, the pressure contact state of the fixing roller pair 20 can be switched between the first pressure contact state and the second pressure contact state by using the nip pressure adjustment mechanisms 60. Thus, in order to print on a multiple-sheet recording medium such as, for example, an envelope, the fixing roller pair 20 is set to the second pressure contact state for printing. By doing this, formation of creases, which otherwise may occur when an envelope or the like passes through the fixing nip portion N, can be prevented.

Figure 6:
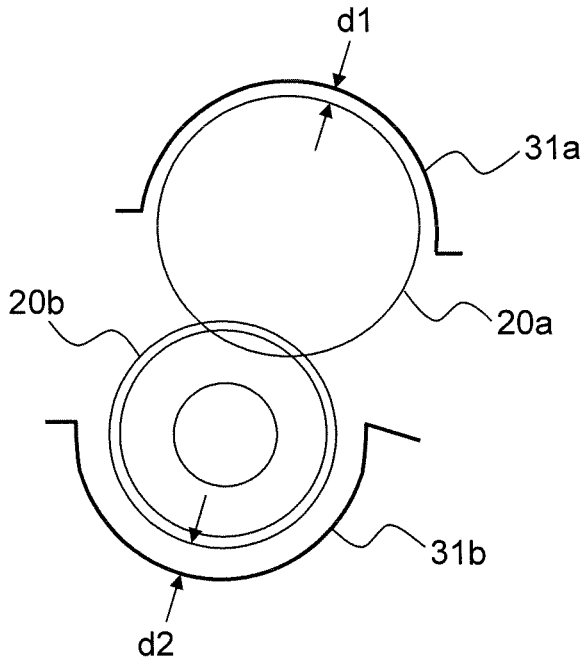
FIG. 6 is a side view illustrating a gap between a heating roller and a heating-side heat conservation plate and a gap between a pressure roller and a pressing-side heat conservation plate when a fixing nip pressure is in a first pressure contact state.
Figure 7:
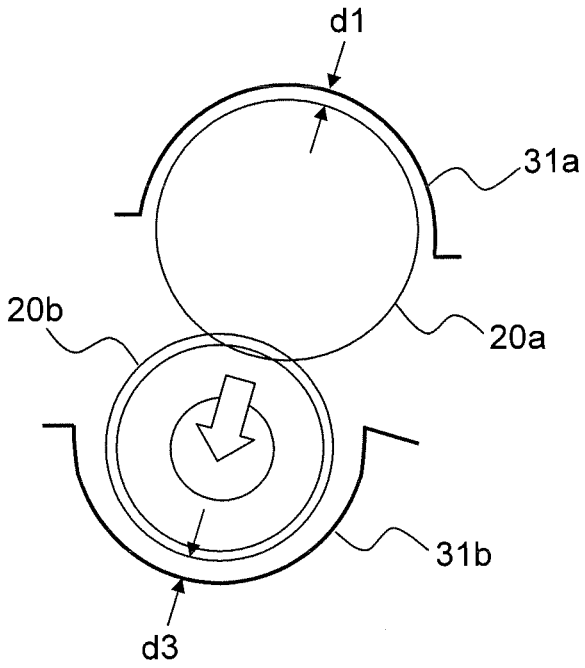
FIG. 7 is a side view illustrating the gap between the heating roller and the heating-side heat conservation plate and a gap between the pressure roller and the pressing-side heat conservation plate when the fixing nip pressure is in a second pressure contact state.

FIGS. 6 and 7 are side views illustrating the positional relationships among the heating roller 20*a*, the pressure roller 20*b*, the heating-side heat conservation plate 31*a*, and the pressing-side heat conservation plate 31*b*. The fixing nip pressure is in the first pressure contact state in FIG. 6 and is in the second pressure contact state in FIG. 7. For convenience of description, only the heating roller 20*a*, the pressure roller 20*b*, the heating-side heat conservation plate 31*a*, and the pressing-side heat conservation plate 31*b* are illustrated in FIGS. 6 and 7.

When the fixing nip pressure is in the first pressure contact state, as illustrated in FIG. 6, the gap between the heating roller 20*a* and the heating-side heat conservation plate 31*a* is d1 and the gap between the pressure roller 20*b* and the pressing-side heat conservation plate 31*b* is d2. When the fixing nip pressure becomes the second pressure contact state by switching the state of each nip pressure adjustment mechanism 60 from the state illustrated in FIG. 4 to the state illustrated in FIG. 5, the pressure roller 20*b* is moved by a specified amount in a direction separating from the heating roller 20*a* (indicated by the hollow arrow in FIG. 7). As a result, the pressure roller 20*b* approaches the pressing-side heat conservation plate 31*b* and the gap between the pressure roller 20*b* and the pressing-side heat conservation plate 31*b* is changed from d2 to d3 (d2>d3).

In an embodiment, when the fixing nip pressure is in the second pressure contact state, the gap d3 between the pressure roller 20*b* and the pressing-side heat conservation plate 31*b* is set to be greater than the gap d1 between the heating roller 20*a* and the heating-side heat conservation plate 31*a*. Thus, when printing on a single-sheet recording medium such as a sheet of plain paper and printing on multiple-sheet recording medium such as an envelope, the heat conserving effect of the pressure roller 20*b* can be improved, and accordingly, power consumption required for increasing the temperature of the heating roller 20*a* can be reduced.

The present disclosure is not limited to the above-described embodiment and a variety of modifications are possible without departing from the gist of the present disclosure. For example, in the above-described embodiment, the end edges of the heating-side heat conservation plate 31*a* and the pressing-side heat conservation plate 31*b* in the circumferential directions of the heating-side heat conservation plate 31*a* and the pressing-side heat conservation plate 31*b* are covered with the fixing entrance guides 23 and 24 and the fixing exit guides 28 and 29. However, dedicated members for covering the end edges of the heating-side heat conservation plate 31*a* and the pressing-side heat conservation plate 31*b* in the circumferential directions of the heating-side heat conservation plate 31*a* and the pressing-side heat conservation plate 31*b* may be provided. Alternatively, one of the end edges of the heating-side heat conservation plate 31*a* in the circumferential direction of the heating-side heat conservation plate 31*a* and one of the end edges of the pressing-side heat conservation plate 31*b* in the circumferential direction of the pressing-side heat conservation plate 31*b* may be covered. In this case, only the end edges on the upstream opening 22*a* side, where the opening width is large, may be covered.

In the above-described embodiment, the heating member uses the cylindrical heating roller 20*a* and the pressing member uses the cylindrical pressure roller 20*b*. Accordingly, the heating-side heat conservation plate 31*a* and the pressing-side heat conservation plate 31*b* have arc cross-sectional shapes along the outer circumferential surfaces of the heating roller 20*a* and the pressure roller 20*b*, respectively. However, the shapes of the heating-side heat conservation plate 31*a* and the pressing-side heat conservation plate 31*b* may be adequately determined based on the shapes of the outer peripheral surfaces of the heating member and the pressing member. For example, with a belt-fixing type fixing device, in which an endless fixing belt is looped over a heating roller and a fixing roller and the fixing roller and a pressure roller are in pressure contact with each other with the fixing belt nipped therebetween, the heating-side heat conservation plate 31*a* may have a shape that conforms to the outer peripheral surface of the fixing belt.

The present disclosure is applicable not only to a monochrome printer as illustrated in FIG. 1 but also to any of other types of image forming apparatuses such as color printers, monochrome copiers, color copiers, digital multi-function peripherals, and facsimile machines.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A fixing device comprising:

a fixing member that includes a heating member heated by a heating unit, and a pressing member that is in pressure contact with the heating member at a specified pressure;

a housing that includes the fixing member and has openings on an upstream side and a downstream side in a recording medium transportation direction;

a heating-side heat conservation plate that is positioned opposite the heating member so as to be spaced apart from an outer peripheral surface of the heating member by a specified distance and has a metal plate having a shape that conforms to the outer peripheral surface of the heating member;

a pressing-side heat conservation plate that is positioned opposite the pressing member so as to be spaced apart from an outer peripheral surface of the pressing member by a specified distance and has a metal plate having a shape that conforms to the outer peripheral surface of the pressing member; and the distance between the pressing member and the pressing-side heat conservation plate is greater than the distance between the heating member and the heating-side heat conservation plate.

2. The fixing device according to claim 1, wherein, with respect to end edges of the heating-side heat conservation plate in a peripheral direction of the heating-side heat conservation plate, at least the end edge on the upstream side in the recording medium transportation direction, is covered with a material having a greater heat insulating property than that of the heating-side heat conservation plate.

3. The fixing device according to claim 2, wherein, with respect to end edges of the pressing-side heat conservation plate in a peripheral direction of the pressing-side heat conservation plate, at least the end edge on the upstream side in the recording medium transportation direction, is covered with a material having a greater heat insulating property than that of the pressing-side heat conservation plate.

4. The fixing device according to claim 3, wherein, with respect to the end edges of the heating-side heat conservation plate in the peripheral direction of the heating-side heat conservation plate or the end edges of the pressing-side heat conservation plate in the peripheral direction of the pressing-side heat conservation plate, the end edge on the upstream side in the recording medium transportation direction is covered with a fixing entrance guide formed of resin, the fixing entrance guide guiding a recording medium that is entering a fixing nip portion.

5. The fixing device according to claim 1, further comprising:

a nip pressure adjustment mechanism that switches a pressure contact state of a fixing nip portion between a first pressure contact state and a second pressure contact state, a pressure applied in the second pressure contact state being less than a pressure applied in the first pressure contact state; and when the fixing nip portion is in the second pressure contact state, the distance between the pressing member and the pressing-side heat conservation plate is greater than the distance between the heating member and the heating-side heat conservation plate.

6. The fixing device according to claim 1, wherein the heating member and the pressing member are respectively a cylindrical heating roller and a cylindrical pressure roller, and the heating-side heat conservation plate and the pressing-side heat conservation plate have an arc cross-sectional shape that conform to circumferential surfaces of the heating member and the pressing member, respectively.

7. An image forming apparatus comprising:

a fixing device that includes;

a fixing member that includes;

a heating member heated by a heating unit, and a pressing member that is in pressure contact with the heating member at a specified pressure, a housing that includes the fixing member and has openings on an upstream side and a downstream side in a recording medium transportation direction, a heating-side heat conservation plate that is positioned opposite the heating member so as to be spaced apart from an outer peripheral surface of the heating member by a specified distance and has a metal plate having a shape that conforms to the outer peripheral surface of the heating member;

a pressing-side heat conservation plate that is positioned opposite the pressing member so as to be spaced apart from an outer peripheral surface of the pressing member by a specified distance and has a metal plate having a shape that conforms to the outer peripheral surface of the pressing member; and the distance between the pressing member and the pressing-side heat conservation plate is greater than the distance between the heating member and the heating-side heat conservation plate.

8. The image forming apparatus according to claim 7, wherein, with respect to end edges of the heating-side heat conservation plate in a peripheral direction of the heating-side heat conservation plate, at least the end edge on the upstream side in the recording medium transportation direction is covered with a material having a greater heat insulating property than that of the heating-side heat conservation plate.

9. The image forming apparatus according to claim 8, wherein, with respect to end edges of the pressing-side heat conservation plate in a peripheral direction of the pressing-side heat conservation plate, at least the end edge on the upstream side in the recording medium transportation direction is covered with a material having a greater heat insulating property than that of the pressing-side heat conservation plate.

10. The image forming apparatus according to claim 9, wherein, with respect to the end edges of the heating-side heat conservation plate in the peripheral direction of the heating-side heat conservation plate or the end edges of the pressing-side heat conservation plate in the peripheral direction of the pressing-side heat conservation plate, the end edge on the upstream side in the recording medium transportation direction is covered with a fixing entrance guide formed of resin, the fixing entrance guide guiding a recording medium that is entering a fixing nip portion.

11. The image forming apparatus according to claim 7, further comprising:

a nip pressure adjustment mechanism that switches a pressure contact state of a fixing nip portion between a first pressure contact state and a second pressure contact state, a pressure applied in the second pressure contact state being less than a pressure applied in the first pressure contact state; and when the fixing nip portion is in the second pressure contact state, the distance between the pressing member and the pressing-side heat conservation plate is greater than the distance between the heating member and the heating-side heat conservation plate.

12. The image forming apparatus according to claim 7, wherein the heating member and the pressing member are respectively a cylindrical heating roller and a cylindrical pressure roller, and the heating-side heat conservation plate and the pressing-side heat conservation plate have an arc cross-sectional shape that conform to circumferential surfaces of the heating member and the pressing member, respectively.

* * * * *